US008650689B2

(12) United States Patent
Koch et al.

(10) Patent No.: US 8,650,689 B2
(45) Date of Patent: Feb. 18, 2014

(54) METHOD FOR CONTROLLING FOAM FORMATION IN A HOUSEHOLD WASHING MACHINE

(75) Inventors: Thomas Koch, Berlin (DE); Ingo Schulze, Panketal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 985 days.

(21) Appl. No.: 12/682,281

(22) PCT Filed: Oct. 15, 2008

(86) PCT No.: PCT/EP2008/063895

§ 371 (c)(1),
(2), (4) Date: Apr. 9, 2010

(87) PCT Pub. No.: WO2009/059875

PCT Pub. Date: May 14, 2009

(65) Prior Publication Data

US 2010/0205752 A1 Aug. 19, 2010

(30) Foreign Application Priority Data

Nov. 6, 2007 (DE) ..... 10 2007 052 837

(51) Int. Cl.
*D06F 39/06* (2006.01)
*D06F 35/00* (2006.01)

(52) U.S. Cl.
USPC ..... 8/158; 68/12.02; 68/12.18; 68/12.23; 68/17 R

(58) Field of Classification Search
USPC ..... 68/17 R, 12.02, 12.18, 12.23; 8/158, 8/159
See application file for complete search history.

(56) References Cited

U.S. PATENT DOCUMENTS

| | | | | |
|---|---|---|---|---|
| 1,948,568 | A | 2/1934 | Faber et al. | |
| 3,314,254 | A * | 4/1967 | Mandarino, Jr. et al. | 68/20 |
| 5,768,730 | A | 6/1998 | Matsumoto et al. | |
| 6,269,506 | B1 | 8/2001 | Hollatz et al. | |
| 6,463,611 | B1 * | 10/2002 | Mattia et al. | 8/158 |
| 6,662,600 | B1 | 12/2003 | Field et al. | |
| 7,340,792 | B2 | 3/2008 | Czyzewski et al. | |
| 2005/0188731 | A1 * | 9/2005 | Aouad | 68/159 |
| 2006/0075576 | A1 * | 4/2006 | Price et al. | 8/115.51 |
| 2006/0248658 | A1 | 11/2006 | Ha et al. | |

FOREIGN PATENT DOCUMENTS

| | | | |
|---|---|---|---|
| CH | 353714 | | 4/1961 |
| DE | 3042832 | A1 | 6/1982 |
| DE | 4104151 | A1 | 8/1992 |
| DE | 4334969 | A1 | 4/1994 |
| DE | 19846248 | A1 | 4/2000 |
| EP | 0278239 | A1 | 8/1988 |
| EP | 1213384 | A2 | 6/2002 |

* cited by examiner

*Primary Examiner* — Joseph L Perrin
(74) *Attorney, Agent, or Firm* — James E. Howard; Andre Pallapies

(57) ABSTRACT

A household washing machine that includes a foam-promoting agent dispenser that adds a predetermined amount of a foam-promoting agent during a washing cycle, and a foam-inhibiting agent dispenser that adds a predetermined amount of a foam-inhibiting agent before the end of a rinsing cycle.

7 Claims, 1 Drawing Sheet

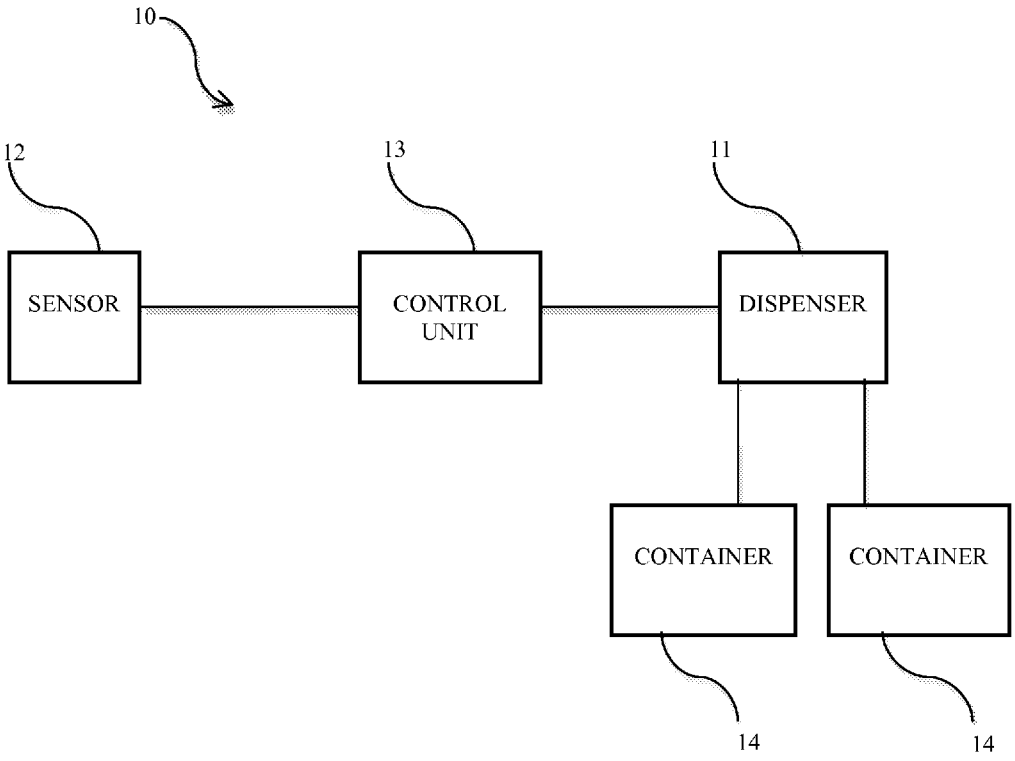
10
12
13
11
SENSOR
CONTROL UNIT
DISPENSER
CONTAINER
CONTAINER
14
14

METHOD FOR CONTROLLING FOAM FORMATION IN A HOUSEHOLD WASHING MACHINE

BACKGROUND OF THE INVENTION

The present invention relates to a method for treatment of laundry in a household washing machine with a foam-forming washing liquor, comprising at least one washing process and at least one rinsing process.

The detergents used in conventional washing machines are based on surfactants. These active washing substances are able, by virtue of their amphiphile molecular structure, to form a thin layer on the surface of the water and thereby reduce the surface tension of the water. It is also the surfactants which lend the water its ability to form foam. The lowering of the surface tension of the aqueous phase by accumulation of surfactants at the boundary surface between water and air has the result that by the introduction of air, such as by a mechanical input for example on rotation of a washing drum, small air bubbles are created and can be partially stabilized by the embodiment of a surface layer without them coalescing too quickly. This means that a dispersion of air in the washing liquor forms the basis for the generation of foam. The foams involved in washing usually involve metastable foams which have a certain, but limited, lifetime. The lifetime is influenced by different variables, for example by the type of surfactant, by its concentration, by the intensity of the air input, by the diameter of the bubbles produced. If the lifetime of the foam is very short, this can be termed an unstable foam.

A distinction is also made between two types of foams: Spherical foams and polyhedral foams. With a foaming liquid such as a washing liquor for example both types generally occur, with the polyhedral foam to be found above the spherical foam.

Small-pore polyhedral foams in particular can however be a hindrance or even be damaging in a washing cycle in a household drum washing machine. These types of small-pore polyhedral foams can form a robust foam carpet which gets into the space between inner drum and tub, remains stuck there and is difficult to pump away. During the rinsing spin cycle this also prevents the spun-off water being transported away. This in its turn leads to an additional buildup of foam. Without foam removal measures this frequently leads to overfoaming of the device, i.e. the foam especially forcing its way out of the openings of the tub, such as the tub ventilation and the filler hose for example. Foam can also have a disadvantageous effect on the pump for pumping away the used washing liquor.

For this reason a number of methods have already been developed in the prior art in order to remove surplus foam. In the prior art this has primarily been attempted by using mechanical methods.

DE 43 34 969 A1 describes a device for destroying detergent foam in a washing machine with a rotatable drum and a tub which has a facility for creating hot air which is directed through an inlet in the tub wall between the tub and the drum.

According to the disclosure of DE 41 04 151 A1 unwanted foam occurring in a washing machine is destroyed by switching on a heating device.

In EP 0 278 239 A1 a disproportionate foam formation in the main wash cycle, which is to be observed during the heating of washing liquid in the tub, is removed by adding a limited amount of cold water and/or by temporarily switching off the tub heating.

The only chemical measure for countering foam known in the state of the art is to introduce fabric softeners at a relatively early stage of the rinsing process since, because of their composition from cationic surfactants, these have a defoaming effect.

DE 102 34 472 A1 specifies different measures for removal of foam, including automatic dispensing of a substance for inhibition of the foam.

Most foam removal measures known in the prior art are however associated with disadvantages, such as increased water consumption, increased power consumption from additional heating and longer idle times which increase the overall duration of a program.

As well as the undesired effects of detergent foam in household washing machines, it has also been shown however that foam can also have entirely advantageous effects. Thus foam attenuates the falling action of the laundry during washing, and this enables the mechanical input to be reduced despite a continuous rotational movement of the drum. This makes a more gentle wash for delicate fabrics possible, such as wool and silk for example. In conventional wool washing methods there is generally provision for long idle periods in which the drum is moved hardly at all in order to keep the mechanical effect on the laundry as low as possible.

BRIEF SUMMARY OF THE INVENTION

The underlying object of the invention is to provide a method for treatment of laundry which on the one hand makes it possible to usefully employ the desired properties of foam during washing without having the disadvantages which a formation of foam brings with it.

This object is inventively achieved by a method as claimed in claim 1. The subclaims relate to preferred forms of embodiment which can be used individually or in combination with each other.

BRIEF DESCRIPTION OF THE DRAWINGS

FIG. 1 is a diagram of a household washing machine.

The inventive method for treating laundry in a household washing machine with a foam-forming washing liquor comprises at least one washing process in which foam-forming washing liquor is used and at least one rinsing process and is characterized in that, for controlling the amount of foam during the washing process, a foam-promoting agent is automatically added in an amount that can be predetermined and before ending of the rinsing process a foam-inhibiting agent is automatically added in an amount that can be predetermined.

This method has the great advantage that the chemical control of the foam formation means that the respective washing program does not have to be modified at all or is only subject to minimal modifications. Expensive waiting times are thus avoided which were previously required for foam removal. At the same time this method also makes it possible to utilize the positive properties of foam formation.

This method is especially suitable for household washing machines 10 with an automatic dispensing device 11.

Preferably the amount of foam formed is monitored by a sensor 12 during the washing process and/or during the rinsing process. These types of foam sensors 12 are already known in the prior art. On the one hand there are pressure sensors, but optical sensors and the like are also especially suitable. Preferably a specific level of foam can be predetermined by setting the foam threshold value so that when a foam threshold is reached, exceeded or undershot, signals can be output in each case so that a corresponding measure can be taken. During washing it can be sensible and desirable to retain a certain amount of foam. The sensor monitors the amount of foam and, if it is less than the foam threshold value, issues a signal to a control unit 13 which makes it possible to automatically dispense a foam-promoting agent. Conversely there can be provision in a preferred embodiment for a foam-inhibiting agent to be added if the foam exceeds a threshold value.

It is also possible to enter different foam threshold values for respective different washing programs. Thus a higher level of foam is demanded for example for a delicate wash cycle for wool or silk than for a full wash cycle. Preferably these foam threshold values will already be entered into the said control unit 13 or the unit will be preprogrammed. The threshold value in its turn is coupled to a signal which makes possible the dispensing of one of the said foam-promoting or foam-inhibiting or foam-stabilizing agents.

Shortly before rinsing or even during rinsing a foam-inhibiting agent is added in order to remove as fully as possible the foam which has formed. In this way the problem is avoided of a blockage of the space between the drum and the tub caused by foam adhering there of preventing the intended driving out the water by the spinning process.

Naturally it is also possible to employ additional device-specific measures to control the amount of foam. For foam generation one such measure is a movement of the drum with as much mechanical input as possible and in addition air can be pumped into the washing liquor. In addition the washing liquor temperature, the water level and the drum movement (speed reversing rhythm etc.), the duration of the drum movement and also the device temperature can be varied in order to promote or reduce formation of foam.

The agents for foam formation, foam stabilization and foam prevention able to be used in the invention are already known in the prior art. Foam-promoting agents include all agents which encourage formation of foam while foam-inhibiting agents are to be understood as those agents which prevent the formation of foam or can destroy existing foam. Foam-promoting agents also include foam-stabilizing agents.

The same surfactants as are already present in conventional detergents can be used as foam-promoting agents. I.e. the detergents used in a desired washing program can in some cases also be used as foam-promoting agents. To form a desired amount of foam the detergent can be dispensed differently, for example by setting a specific concentration or also by step-by-step or continuous dispensing until the desired overall amount is reached. During the dispensing of the treatment agent, which as a rule contains surfactants, the drum can be moved at the same time so that the mechanical effect gives rise to a certain input of air and the foam can form. For those cases in which the movement of the drum is reduced a foam-promoting agent can additionally be added in order to form sufficient foam even with little movement and mechanical effect. The foam-inhibiting agent can, in addition to its main function, possess further functions supporting the rinsing process such as reducing the alkalinity, complex formation, flocculation and such like.

The foam-forming washing liquor is an aqueous solution of water and treatment agents which is used during the washing process for treating the laundry. Treatment agents comprise conventional detergents, washing aids, additional substances and the foam-promoting and foam-inhibiting agents. During the rinsing cycle the washing liquor is gradually replaced by fresh water.

In an advantageous engineering embodiment of the invention the household washing machine 10 possesses one or more containers 14 for holding the above agents as well as a dispensing facility 11 for automatically adding the agents during the washing and rinsing cycle. Preferably these means can where necessary be refilled or emptied by the user. The containers 14 can also be embodied as single-use cartridges or refillable cartridges.

The control device present in modern household washing machined can be provided with a suitable control program for controlling the inventive method which executes the process steps.

In an especially preferred embodiment a part quantity of a foam-forming detergent is added to laundry during a washing cycle. Subsequently or simultaneously foam is built up by the rotating drum at a predetermined speed, as a rule the normal washing speed, which in a commercially-available washing machine is around 55 rpm. The quantity of foam is continuously monitored via a foam sensor 12 and thus a predetermined level of foam is roughly set. Subsequently the fine adjustment of the quantity of foam is achieved by defined addition of foam-promoting, foam-stabilizing and/or foam-inhibiting agents. This can be done both with and also without modification of the other device parameters. After the washing process has been successfully carried out the foam is removed again by addition of a foam-inhibiting agent. This can likewise be done with and also without modifying the other device parameters. Short water and energy-saving sequences are achieved in this way.

The present invention makes a fast and efficient foam generation/stabilization and removal possible as well as an energy-saving and water saving treatment of laundry.

The invention claimed is:

1. A method for treatment of laundry in a household washing machine with a foam-forming washing liquor, comprising:

entering a foam threshold into a control unit;

monitoring an amount of foam with a sensor during a washing cycle and before and/or during a rinsing cycle;

automatically adding a predetermined amount of a foam-promoting agent during the washing cycle until the foam threshold is reached when the quantity of foam monitored by the sensor during the washing cycle is less than the foam threshold; and adding a predetermined amount of a foam-inhibiting agent before the end of the rinsing cycle based on the monitored quantity of foam by the sensor before and/or during the rinsing cycle.

2. The method of claim 1, further comprising:

adding a foam-inhibiting agent if an amount of foam exceeds the foam threshold.

3. The method of claim 1, further comprising employing additional device-specific measures to control an amount of foam.

4. The method of claim 3, wherein the device-specific measures comprise a variation of a device temperature, a washing liquor temperature, a water level, a delivery power of an air pump, a drum movement, a duration of the drum movement, or a drum speed.

5. A household washing machine comprising:

a control unit into which a foam threshold value is entered;

a sensor operatively connected to the control unit and which monitors a quantity of foam during a washing cycle;

a dispenser which dispenses a foam-promoting agent and a foam-inhibiting agent;

wherein the dispenser is controlled by the control unit to automatically dispense a predetermined amount of foam-inhibiting agent during the washing cycle until the foam threshold is reached when the quantity of foam monitored by the sensor during the washing cycle is greater than the foam threshold.

6. A household washing machine comprising:

a control unit;

a sensor operatively connected to the control unit and which monitors a quantity of foam before or during a rinsing cycle; and a dispenser which dispenses a foam-promoting agent and a foam-inhibiting agent, wherein the dispenser is controlled by the control unit to automatically dispense a predetermined amount of foam-inhibiting agent before the end of the rinsing cycle based on the monitored quantity of foam by the sensor before and/or during the rinsing cycle.

7. A household washing machine comprising:

a control unit;

a sensor operatively connected to the control unit and which monitors a quantity of foam during a washing cycle and a quantity of foam during a rinsing cycle; and a dispenser which dispenses a foam-promoting agent and a foam-inhibiting agent, wherein the dispenser is controlled by the control unit to:

automatically dispense a predetermined amount of foam-promoting agent during the washing cycle until the foam threshold is reached when the quantity of foam monitored by the sensor during the washing cycle is less than the foam threshold;

automatically dispense a predetermined amount of foam-inhibiting agent during the washing cycle until the foam threshold is reached when the quantity of foam monitored by the sensor during the washing cycle is greater than the foam threshold; and automatically dispense a predetermined amount of foam-inhibiting agent before the end of the rinsing cycle based on the monitored quantity of foam by the sensor before and/or during the rinsing cycle.

* * * * *

UNITED STATES PATENT AND TRADEMARK OFFICE

CERTIFICATE OF CORRECTION

PATENT NO. : 8,650,689 B2
APPLICATION NO. : 12/682281
DATED : February 18, 2014
INVENTOR(S) : Koch et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 986 days.

Signed and Sealed this
Twenty-ninth Day of September, 2015

Michelle K. Lee

Michelle K. Lee
*Director of the United States Patent and Trademark Office*